US007637134B2

(12) United States Patent
Burzlaff et al.

(10) Patent No.: US 7,637,134 B2
(45) Date of Patent: Dec. 29, 2009

(54) FLANGING WITH A LEADING AND FOLLOWING FLANGING DIE

(75) Inventors: Marc Burzlaff, Hofbieber-Elters (DE); Stefan Reith, Hofbieber (DE); Manfred Hohmann, Hünfeld (DE)

(73) Assignee: EDAG GmbH & Co. KGaA, Fulda (DE)

( * ) Notice: Subject to any disclaimer, the term of this patent is extended or adjusted under 35 U.S.C. 154(b) by 556 days.

(21) Appl. No.: 11/343,572

(22) Filed: Jan. 31, 2006

(65) Prior Publication Data

US 2006/0288752 A1 Dec. 28, 2006

(30) Foreign Application Priority Data

Jan. 31, 2005 (DE) ..... 10 2005 004 474

(51) Int. Cl.
*B21D 39/02* (2006.01)

(52) U.S. Cl. ..... 72/220; 72/101; 29/243.58

(58) Field of Classification Search ..... 72/101, 72/120, 214, 220; 29/243.5, 243.523, 243.58
See application file for complete search history.

(56) References Cited

U.S. PATENT DOCUMENTS 5,228,190 A * 7/1993 Sawa ..... 29/715
2005/0015955 A1* 1/2005 Quell et al. ..... 29/243.58

FOREIGN PATENT DOCUMENTS

| | | | |
|---|---|---|---|
| DE | 29914967 | U1 | 11/2000 |
| DE | 10011854 | | 9/2001 |
| DE | 10028706 | | 12/2001 |
| DE | 10111374 | | 9/2002 |
| EP | 1 097 759 | A1 | 5/2001 |
| EP | 1 162 011 | A2 | 12/2001 |
| EP | 1 447 155 | A | 8/2004 |
| JP | 2001 062530 | A | 7/2001 |
| WO | WO03/024641 | | 3/2003 |

OTHER PUBLICATIONS

European Search Report dated May 29, 2006, application No. EP 06 00 1600.

* cited by examiner

*Primary Examiner*—Dana Ross
*Assistant Examiner*—Mohammad Yusuf
(74) *Attorney, Agent, or Firm*—RatnerPrestia

(57) ABSTRACT

A flanging device for beading a flanging web of a component part around a flanging edge. The flanging device includes a tool head; a first flanging die and a second flanging die which the tool head simultaneously bears, situated in a processing position, and one of which is arranged following the other in a processing direction.

25 Claims, 7 Drawing Sheets

Figure 2
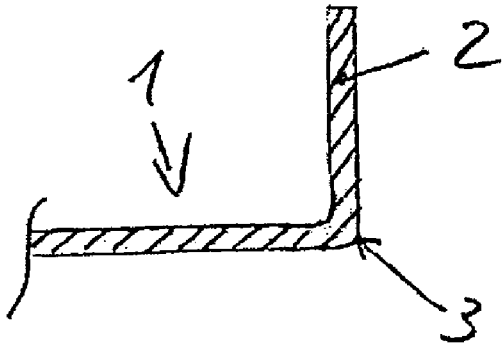
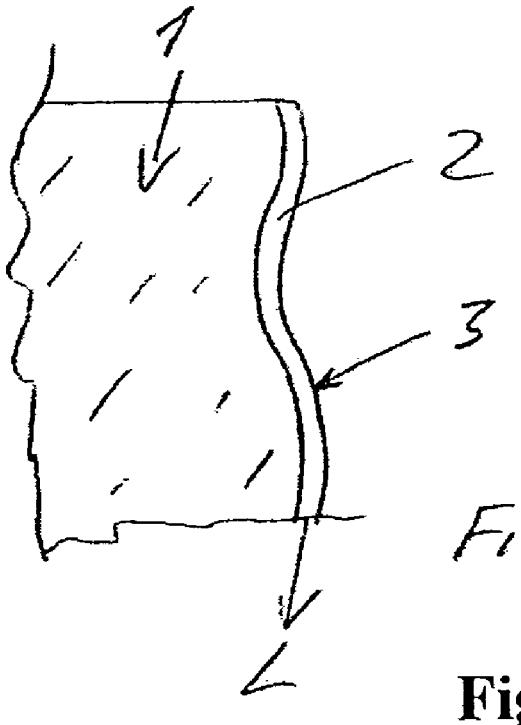
Figure 3

FLANGING WITH A LEADING AND FOLLOWING FLANGING DIE

BACKGROUND OF INVENTION

1. Technical Field

The invention relates to a device and a method for flanging, preferably roll-flanging, a component part. The device and the method preferably serve for hemming, particularly preferably roll-hemming. The invention can in particular be used in the construction of vehicles, preferably the construction of motor vehicles. Body parts, for example a door, a wheel arch or other part of an outer side wall, the front or rear of a motor vehicle, may in particular be considered as component parts to be reshaped.

2. Description of the Related Art

A roll-hemming device is known from WO 03/024641 A1, comprising three hemming, rollers which are used consecutively in a plurality of processing runs and, for this purpose, can optionally be moved into a processing position in which they roll off on a hemming web and bead the hemming web. In order to completely bead the hemming web around a hemming edge, the known device requires three processing runs, between which the next hemming roller in each case has to be moved into its processing position.

It is therefore an object of the invention to reduce the time and therefore cost of flanging, required for multiple-stage flanging, preferably roll-flanging.

SUMMARY OF THE INVENTION

The subject of the invention is a flanging device including a tool head, a first flanging die and at least one other, second flanging die which can be moved in a processing direction along a flanging edge of the component part, in order to act on a flanging web of a component part during roll-flanging and successively bead the flanging web around a flanging edge. The tool head serves as a bearer for the at least two flanging dies. The first and second flanging dies are arranged on the tool head such that they simultaneously assume their respective processing position, i.e. in a processing run, one of the flanging dies serves as a primary flanging die and the other serves as a following secondary flanging die in the same processing run. The tool head preferably serves as a bearer for only two flanging dies. It is also preferable if the secondary flanging die is used as a finishing flanging die. In principle, however, it is possible for the tool head to bear another flanging die between the two flanging dies or downstream of the secondary flanging die or upstream of the primary flanging die, wherein if the flanging die is interposed, then it expediently assumes its processing position at the same time as the other two flanging dies, whereas if it is upstream or downstream, then it can assume its processing position together with the other two flanging dies or, in an alternative embodiment, can be moved into its processing position before or after performing a processing run using the at least two flanging dies, and the at least two flanging dies can be moved out of the processing position, or vice versa.

The flanging dies are a constituent of the common tool head and are moved as a unit when the tool head is moved, which not only enables two flanging steps to be performed within a short period of time in a single processing run, but also means a single actuator which can be spatially moved is sufficient as a platform. The effort which has to be expended for controlling the movement of the actuator corresponds to the effort which previously had to be expended for each processing run for just one flanging roller. The flanging dies are mechanically fixed in a plurality of degrees of freedom relative to each other, at least during the processing run, and therefore cannot be moved relative to each other by means of a controller with respect to these degrees of freedom, wherein mechanically fixing is also understood to mean fixing by means of a hydraulic or pneumatic force. In particular, the flanging dies should be fixed relative to each other with regard to orientation, i.e. their angular position. By contrast, a translational mobility of one of the flanging rollers, preferably a linear mobility along a single axis or at most a two-dimensional mobility, is advantageous. Parallel to the processing direction, however, the flanging dies are preferably fixed relative to each other in terms of their location and therefore cannot be moved relative to each other, at least during the processing run.

In a simple embodiment, the flanging dies can each be arranged on the tool head in a position which is fixed, i.e. always non-variable or at least non-variable during the common processing run. The invention always understands the position of a flanging die to mean the location and/or orientation of the flanging die. The positions can be absolutely invariable. Alternatively, at least one of the flanging dies can be adjustably arranged on the tool head in a retracted state from the component part between two processing runs, in order to be able to adapt the tool head to different component parts.

In preferred embodiments, the first flanging die is arranged on the tool head such that it can be moved, such that its position—namely, its orientation or preferably its location relative to the second flanging die—is variable. Preferably, its position relative to the second flanging die changes automatically during the processing run, such that the tool head adapts to the shape of the flanging edge or a force exerted by the first flanging die on the flanging web remains constant or is varied as desired. The mobility can just as advantageously also be merely that the first flanging die can be automatically moved by means of an actuating means of the tool head, for example in order to move it towards the flanging web or away from the flanging web, wherein the second flanging die can be in or out of contact with the flanging web. In such embodiments, the flanging device includes a bearing unit for the first flanging die, which is mounted by the tool head such that it can be moved.

The first flanging die is mounted by the bearing unit, preferably stationary relative to the bearing unit. The bearing unit is mounted by the tool head such that it can be moved, preferably in a transverse direction to the flanging edge, i.e. in and counter to a direction transverse to the processing direction of the tool head. This enables the first flanging die to move relative to the second flanging die in said transverse direction. The tool head expediently mounts the bearing unit such that it can be moved linearly in the transverse direction, preferably secured against rotating.

The first flanging die can preferably be advanced in the transverse direction towards the flanging web far enough that it protrudes beyond the second flanging die, preferably far enough that if a flanging edge is linear and at a right angle to the transverse direction, the first flanging die can act on the flanging web without the second flanging die. Such an embodiment enables the tool head to contact the flanging web only with the first flanging die, while the second flanging die is positioned away from the component part. This is advantageous in restricted regions and for moving over regions having a small radius of curvature, such as corner regions. If the first flanging die is the following flanging die which completely beads the flanging web, it can be used for reworking for example a corner region, in order to improve the quality of the flanged component part in said region. Using such a flanging die, the corner can be ironed, so to speak. The following flanging die can pass over the corner region repeatedly and act on it each time. For a restricted available space, the first flanging die can preferably be moved back in the transverse direction far enough away from the flanging web—instead of extending far or preferably in addition to this capability—that it is short of the second flanging die, preferably far enough that if a flanging edge is linear and at a right angle to the transverse direction, the second flanging die can act on the flanging web without the first flanging die. This also improves the manoeuvrability of the tool head and facilitates passing over corner regions. That which has been said with respect to the first flanging die is also advantageous for the second flanging die, wherein the relationships described above then apply in reverse, with the roles of the flanging dies swapped, or in a further development apply to both flanging dies.

In preferred variants, the invention enables two flanging steps to be performed in a single processing run of the tool head, even along a curved flanging edge.

In the method in accordance with the invention, the tool head is guided such that it—and together with it, the second flanging die—follows the contour of the edge, while curves which a flanging edge extending in a plane exhibits in said plane or which a flanging edge extending three-dimensionally exhibits in a development are compensated for by means of the transverse mobility of the bearing unit.

The device and method in accordance with the invention can advantageously be formed as a hemming device and serve for hemming, i.e. producing a hemmed connection. They are, however, also advantageous for edge-bending the periphery of a component part, wherein the bending process need not serve to join two or as applicable more components of the component part but rather only to edge-bend a component part which is for example in only one piece. The flanging web also need not be bent around the flanging edge as far as a position parallel to an opposing web of the component part, i.e. need not be completely beaded; rather, the invention is also advantageous for flanging by any bending angle.

The flanging dies can be formed as sliding pieces which, for beading the flanging web, press against the flanging web and slide along the flanging edge. In such embodiments, the effective areas of the flanging dies, contacting the flanging web, are preferably cylindrical. Flanging dies formed as sliding pieces can be realised in a space-saving way and are therefore advantageous in restricted flanging regions.

Preferably, at least one of the flanging dies is formed as a flanging roller. Preferably, each of the at least two flanging dies is formed as a flanging roller. If only one of the flanging dies is a flanging roller, then preferably the first flanging die. If the tool head also bears another flanging die, it is preferable if said other flanging die is also formed as a flanging roller.

The first flanging die and the second flanging die advantageously exhibit only a small distance from each other in the processing direction of the tool head. If, during flanging, the bearing unit performs compensating movements due to curves in the contour of the edge, the amplitude of these is correspondingly small. The clear distance between the effective areas of the flanging dies, measured in the processing direction, should not exceed a few centimetres; preferably, the clear distance measures 10 cm at most, even more preferably 5 or 4 cm at most.

In a first variant, the transverse direction in which the first flanging die can be moved relative to the second flanging die points angularly, Le. at an angle greater than 00 and less than 1800, to a pressure force with which the first flanging die presses against the flanging web during beading. If a flanging roller forms the first flanging die, then in particular it does not point perpendicular to the rotational axis of said flanging roller in such an embodiment, but rather has at least a direction component which coincides with the rotational axis. The bearing unit compensates for curves in the flanging edge and in this sense acts as a compensating unit.

In a second variant, the transverse direction is at least substantially parallel to the pressure force or has at least a direction component in common with the pressure force. It is preferably flush with the pressure force. If the first flanging die is a flanging roller, the transverse direction in such an embodiment in particular does not point parallel to the rotational axis of said flanging roller, but rather has at least a direction component at a right angle to the rotational axis. It is particularly preferable for the second variant if the first flanging die is orientated such that it completely beads the flanging web, such that the component part is bent over by 1800 at the flanging edge. In this case, the first flanging die can slide on the beaded flanging web to a limited extent, so as to compensate for a curved contour of the flanging edge.

Because it is arranged such that it can be moved, the bearing unit can be charged in the acting direction on the flanging web, which advantageously coincides with the transverse direction, with a particular force, preferably an adjustable force. In such embodiments, the device includes a regulating means for adjusting the force. The force is preferably kept constant during the processing run. In a further development, the force is varied, program-controlled, during the processing run, for example in order to compensate for the strength of the component part varying in the flanging region in the processing direction. The mobility can also only or additionally serve to move the first flanging die towards or away from the flanging web, independent of the second flanging die. The force can press the bearing unit against a stopper. It can be large enough that the bearing unit cannot be lifted off the stopper by the forces arising during use and is therefore unyielding. More preferably, however, the force is selected such that the pressure force acting on the flanging web is constant during the processing run, as mentioned. In such embodiments, the bearing unit acts as a compensating unit for compensating for forces. It also makes it easier for the first flanging die to follow a curved contour of the flanging edge and acts as a compensating unit in this sense too.

In order to guide the first flanging die such that it follows the contour of the flanging edge, a preferred embodiment of the device has a scanning means which records the contour of the edge. The scanning means can be or can include a sensor which operates without contact, for example an optical sensor or an ultrasound sensor, which feeds a position signal to a control or regulating means which adjusts the bearing unit accordingly. In an alternative embodiment, the scanning means is or includes a guiding member formed as a contact recorder, which is held in guiding contact with a guiding curve corresponding to the contour of the edge. Although such a guiding member could in principle also be used only via an interposed control or regulating means with an actuating means for controlling or regulating the transverse movements of the bearing unit, it is also preferable if the guiding member is mechanically connected to the bearing unit such that it slaves the bearing unit when moving along the guiding curve in the transverse direction to the guiding curve. The guiding member is expediently arranged stationary on the bearing unit. The guiding member can for example be a sliding piece, but is advantageously formed as a roller and in the guiding contact, rolls off on the guiding curve. The guiding member advantageously forms a contact area for the guiding contact, such that during beading, the contact area is in guiding contact with a guiding curve formed on the other side of the flanging edge, as viewed from the flanging web, or directly with a guiding curve formed by the flanging edge or the flanging web. The guiding member is preferably pressed into the guiding contact by an elasticity force, preferably pneumatically. It is advantageous if the guiding member forms a contact area for the guiding contact which is arranged level with the first flanging die in the processing direction.

Instead of recording the contour of the edge by means of a scanning means, a control means can be provided which adjusts the first flanging die relative to the second in the transverse direction, in accordance with stored position co-ordinates for the edge, i.e. without scanning.

In a preferred embodiment, the second flanging die is supported on the tool head via a force measuring means, preferably a load cell. During the processing run, the force measuring means can measure the force exerted by the second flanging die on the flanging web. The force ascertained by measurement is compared with a target force. The movement trajectory of the tool head is optimised in accordance with the result of the comparison, for example the difference between the actual force measured and the predefined target force. The movement trajectory in the form of an ideal contour of the flanging edge can thus be predefined for a movement controller of the tool head, i.e. a movement controller of the actuator bearing the tool head, preferably a programmed movement controller. The target force contour is also predefined for the movement controller along the movement trajectory. When travelling the predefined movement trajectory, however, deviations between the predefined target force and the actual force ascertained by measurement can arise. In advantageous developments, the movement controller optimises the movement trajectory in accordance with the comparison between the target force and the actual force in such a way that the contour of the flanging edge comes as near as possible to the ideal contour and the actual force simultaneously corresponds as far as possible to the target force. Ascertaining the actual force and, on the basis of this, optimising the movement trajectory is advantageous in series production, in particular when introducing a new series, in order to optimise the movement trajectory during the first component parts of a new series. Once the movement trajectory is optimised, the force measuring means can be switched off for the remaining course of the respective series and the tool head can be guided on the optimised movement trajectory. In the course of a series, the actual force can as applicable be verified again at a later point in time and the movement trajectory re-optimised. The force measuring means can of course also be switched on for the whole series, i.e. when flanging component parts of a series which are always the same, in order to constantly optimise the movement trajectory when deviations between the actual force and the target force are detected or at least when a definitive tendency is recognised.

The device and method in accordance with the invention can be used both with a component part which is accommodated in a component part receptacle—a flanging bed and with a free component part, for example a completed body shell. If the component part is not accommodated in a component part receptacle, the tool head preferably bears support rollers, namely one support roller for each flanging die, arranged opposite the assigned flanging die, in order to absorb the bending force arising in each case during beading.

In one embodiment, a component part receptacle—a flanging bed—forms the guiding curve. In another embodiment, the component part itself forms the guiding curve, for example the flanging web or the flanging edge or preferably a component part strip extending on the other side of the flanging edge, as viewed from the flanging web.

In preferred embodiments, the bearing unit is charged with a pneumatic force in the direction of its transverse mobility, in order to hold the first flanging die during a processing run in a position in which it beads the flanging web by the predefined bending angle. Instead of pneumatically, the force required for this could be generated by means of a mechanical spring or a system consisting of a plurality of mechanical springs. Generating the force pneumatically, however, has the advantage that the magnitude of the force can be more precisely predefined, by correspondingly dimensioning the pressure area of a piston which can be charged with the pneumatic pressure, material fatigue need not be feared as much, and the movement direction of the bearing unit can easily be reversed, if for example a piston-cylinder arrangement is used comprising a piston which can be pressurised on both sides. If a pressure generator is used, by means of which the pneumatic pressure can be varied, then the magnitude of the force can be flexibly selected in accordance with the requirements in each case, differing from one flanging task to another or from flanging device to flanging device, even under otherwise given conditions during operation. Reversibility can be advantageous in order to place the first flanging die on the flanging web or remove it from the flanging web before or after the second flanging die. This can be advantageous if the space available is restricted. In such embodiments, the first flanging die can be moved sufficiently far in the transverse direction beyond the second flanging die or behind it. A mechanical spring or a system consisting of a plurality of mutually adjusted mechanical springs can also be provided, to support a pneumatic force.

Although the bearing unit is preferably charged with a spring force in the direction of its transverse mobility, in order to press the flanging roller elastically against the flanging web, so as to compensate for unevenness, it is advantageous in alternative embodiments if the transverse force is not generated as an elasticity force but rather as a rigid force, for example hydraulically or by means of an electromotor, or as a correspondingly large pneumatic force.

Expediently, the tool head can be spatially moved in all three co-ordinate directions, as well as preferably in all three rotational degrees of freedom, in a controlled and as applicable also regulated way, such that it can be automatically positioned relative to the component part and guided such that it follows the contour of the flanging edge. To this end, it is or can be fastened to an actuator, preferably a robot arm, which can accordingly be moved.

As already mentioned, the invention can be used for flanging component parts for which a component part receptacle absorbs the reaction force arising during flanging. For flanging a component part accommodated in a component part receptacle, the tool head is charged with a force in a direction towards the flanging web, in order to apply the reshaping pressure and therefore the bending force required for beading the flanging web. In the first variant, the direction of the transverse mobility of the first flanging roller points at an angle greater than 00 and less than 1800, preferably at a right angle, to the force with which the tool head can be pressed against the flanging web via the flanging dies, in order to bead the flanging web. In the second variant, the direction of the transverse mobility preferably points at least substantially in the direction of force; expediently, the directions are identical.

While the component part receptacle absorbs the reaction force when flanging a component part accommodated by a component part receptacle, the tool head in a flanging device and method with no component part receptacle—which also represent a preferred subject of the invention—serves as a bearer for at least one, preferably precisely one, support roller for each flanging die. Saving on processing runs is also very advantageous economically for such component parts, for example a component part of a side wall for a motor vehicle or an already completed body shell, for example a wheel arch. For such devices and methods, the tool head also serves as a bearer for one support roller for each flanging die, in order to absorb the bending force to be applied for each flanging die when beading the flanging web. The at least two flanging die are accordingly assigned two support rollers. If transverse mobility is provided, one of the support rollers is advantageously rotatably mounted together with the first flanging die by the bearing unit, such that the reshaping pair formed from the first flanging die and its support roller can be moved in the transverse direction to the processing direction, relative to the second flanging die and its assigned support roller.

For its transverse mobility, the bearing unit can be floatingly mounted in the first variant, preferably with no force, between end stoppers which limit the transverse mobility in both directions. The bearing unit, or as applicable another bearing unit, can also additionally be mounted in both variants such that it can also be moved in another transverse direction, in order for example to compensate for curves in the flanging edge about axes which have different spatial orientations. The directions of such a duplex transverse mobility preferably point at a right angle to each other and also to the processing direction of the tool head. In principle, however, they can also point at other angles to each other and to the processing direction. Instead of mounting the first flanging die such that it can be moved transversely in two different directions, namely via its bearing unit, the second flanging die can also be mounted by a bearing unit which for its part is mounted by the tool head such that it can be moved transversely in a different direction to the bearing unit comprising the first flanging die.

BRIEF DESCRIPTION OF THE DRAWINGS

An example embodiment of the invention is explained below on the basis of figures. Features disclosed by the example embodiment, individually and in any combination of features, advantageously develop the subjects of the claims and also the embodiments described above. There is shown:

FIG. 2 a flanging region of a component part to be flanged, in a cross-section;

FIG. 3 the flanging region in a top view;

DETAILED DESCRIPTION OF THE PREFERRED EMBODIMENTS

Detailed Description of the Preferred Embodiments

Figure 1:
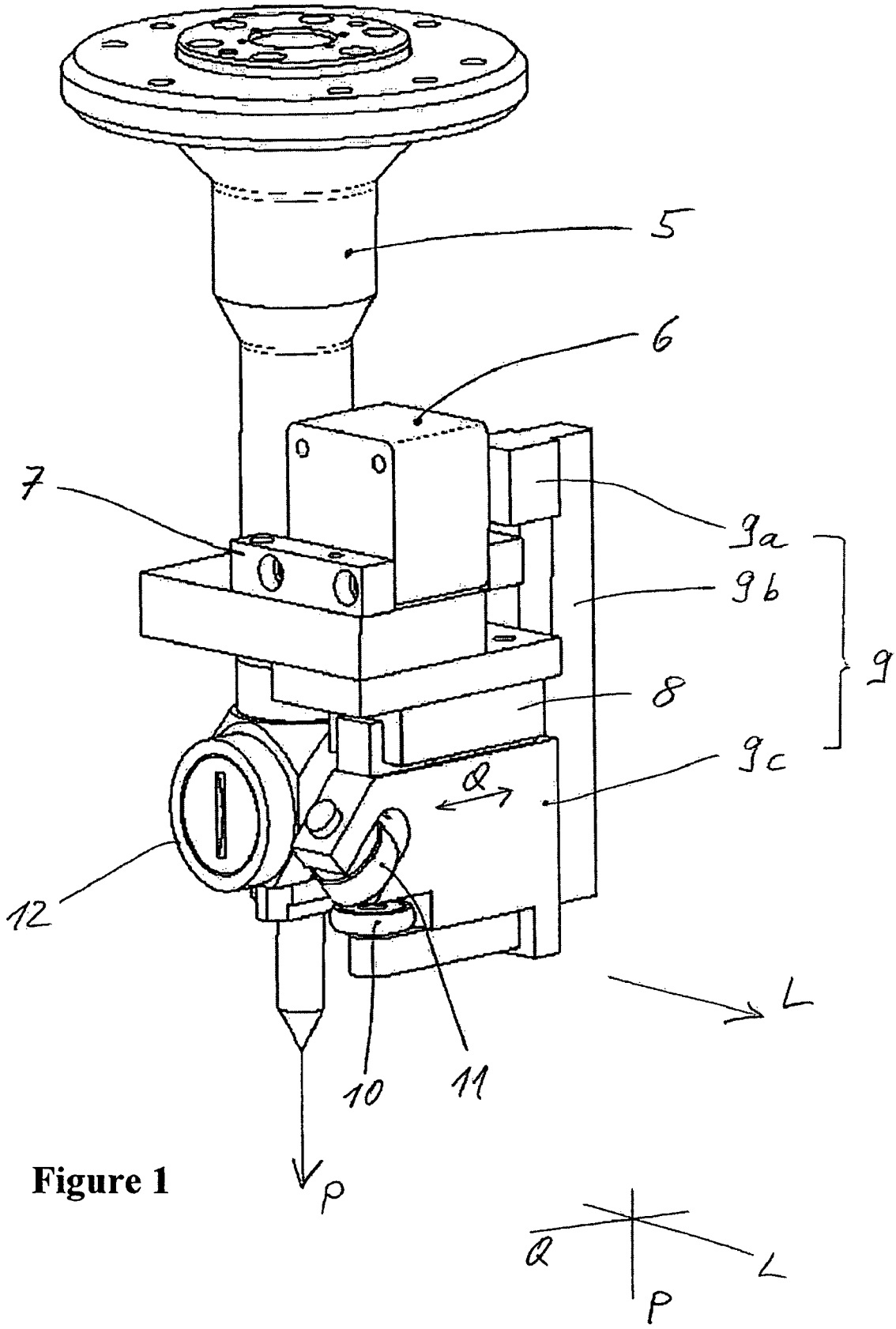
FIG. 1 a first roll-flanging device.

FIG. 1 shows a roll-flanging device in a first example embodiment. The roll-flanging device forms an end effector of a robot. It is a tool head 5 which is provided with a connecting flange for connecting to the end of a joint arm of the robot. The tool head 5 serves as a bearer for a total of two flanging dies, namely a first flanging roller 11 and a second flanging roller 12. The flanging rollers 11 and 12 are used simultaneously in a processing run of the tool head 5. The first flanging roller 11 operates as a primary flanging roller and the second flanging roller 12 operates as a secondary flanging roller. In accordance with their function, the flanging rollers 11 and 12 are referred to below as the primary flanging roller 11 and the secondary flanging roller 12.

FIG. 2 shows a peripheral region of a pre-shaped metal sheet 1 of a component part. Pre-shaping has produced a flanging web 2 which points at a right angle to an adjacent peripheral strip of the metal sheet 1 along a flanging edge 3.

FIG. 3 shows a top view onto the peripheral region of the metal sheet 1, in a development. The flanging edge 3 has a curved contour in the plane of the development. The processing direction of the roll-flanging device, which coincides with the local longitudinal direction of the flanging edge 3, is indicated by L.

The primary flanging roller 11 and the secondary flanging roller 12 are arranged on the tool head 5, and their rotational axes are orientated such that they completely bead the flanging web 2 in two flanging steps, in a single processing run of the tool head 5, such that after roll-flanging, the flanging web 2 points parallel to the peripheral strip of the metal sheet 1 adjacent to the other side of the flanging edge 3. In this way, a hem slot is formed for a clamped connection between the metal sheet 1 and another metal sheet, an end of which protrudes into the hem slot. Instead of a metal sheet, a peripheral strip of a structure made of a different material, for example plastic, can also be held in the hem slot. If a hemmed connection is produced by roll-flanging, the metal sheet 1 and the structure to be joined to it are positioned accordingly with respect to each other.

The secondary flanging roller 12 is connected stationary to the tool head 5. The location and orientation of its rotational axis are fixed at least during a processing run. In the example embodiment, the location and orientation of the rotational axis are also non-variable between processing runs. The rotational axis of the secondary flanging roller 12 points at a right angle to a fixed body axis P of the tool head 5.

The rotational axis of the secondary flanging roller 12 points at a right angle to the axis P. The rotational axis of the primary flanging roller 11 is inclined relative to each of the rotational axis of the secondary flanging roller 12 and the axis P. The angle of inclination of the rotational axis of the primary flanging roller 11, intersected with the rotational axis of the secondary flanging roller 12 by being shifted in parallel, measures 45°. Other angles of inclination are however also possible within the scope of the known limits. With the angular positions of the flanging rollers 11 and 12 of the example embodiment, however, a flanging web pre-canted at a right angle is advantageously completely beaded using just two flanging rollers. The angle of inclination of the primary flanging roller 11 to the axis P is also 45°.

In order to compensate for curves which the component part 1 exhibits between the current effective location of the primary flanging roller 11 and the effective location of the secondary flanging roller 12 arranged following, the position of the primary flanging roller 11 is variable relative to the tool head 5 and in particular relative to the secondary flanging roller 12. The angle of inclination of the primary flanging roller 11 is maintained during the changes in position. The direction Q of the relative mobility of the primary flanging roller 11 points transverse—in the example embodiment, at a right angle—to the processing direction L, i.e. to the flanging edge 3. It also points parallel to the peripheral strip of the component part 1, onto which the flanging web 2 is beaded, which simultaneously means that the direction Q of the transverse mobility extends parallel to the rotational axis of the secondary flanging roller 12. In other flanging tasks, for which the rotational axis of the secondary flanging roller 12 is not orientated for completely beading the flanging web 2, the latter would not apply.

The body axis P of the tool head 5, the processing direction L and the direction Q of the transverse mobility of the primary flanging roller 11 are not parallel to each other in their respective pairs, i.e. they point angularly to each other in their respective pairs. In the example embodiment, they form a right-angled co-ordinate system; in principle, however, other angular relationships are also not excluded. During roll-flanging, the tool head 5 is charged with a force along the axis P, in the direction indicated, in order to press the flanging rollers 11 and 12 against the flanging web 2 and therefore successively bead the flanging web 2 in accordance with the inclination of the rotational axes of the flanging rollers 11 and 12.

For the transverse mobility of the primary flanging roller 11, the tool head 5 includes a bearing unit 9 acting as a compensating unit, which is mounted by the tool head 5 such that it can be moved in the transverse direction Q and which for its part rotatably mounts the primary flanging roller 11. The bearing unit 9 forms a carriage which can be linearly moved, secured against rotating, in the direction Q relative to the tool head 5. Since the bearing unit 9 is borne by the tool head 5 and is thus a constituent of the tool head 5, the bearing unit 9 is more precisely mounted not by the tool head 5 as such but rather by a bearing part of the tool head 5. This bearing part includes a cylinder unit 6 of a pressing means and a guide 8 for guiding the bearing unit 9 in the transverse direction Q. The bearing unit 9 includes a piston unit 9*a* which in co-operation with the cylinder unit 6 forms the pressing means, a bearing structure 9*c* which rotatably mounts the primary flanging roller 11, and a connecting structure 9*b* which rigidly connects the piston unit 9*a* to the bearing structure 9*c* and is shaped like a bracket.

The pressing means is a pneumatic pressure generator and formed as a cylinder-piston unit from the cylinder unit 6 and the piston unit 9*a*. The piston unit 9*a* consists of a piston and a piston rod. The cylinder unit 6 forms a cylinder for the piston. The piston rod is connected to the connecting structure 9*b*. The pressing means also includes a port 7 for a pressurised gas, preferably pressurised air.

Figure 4:
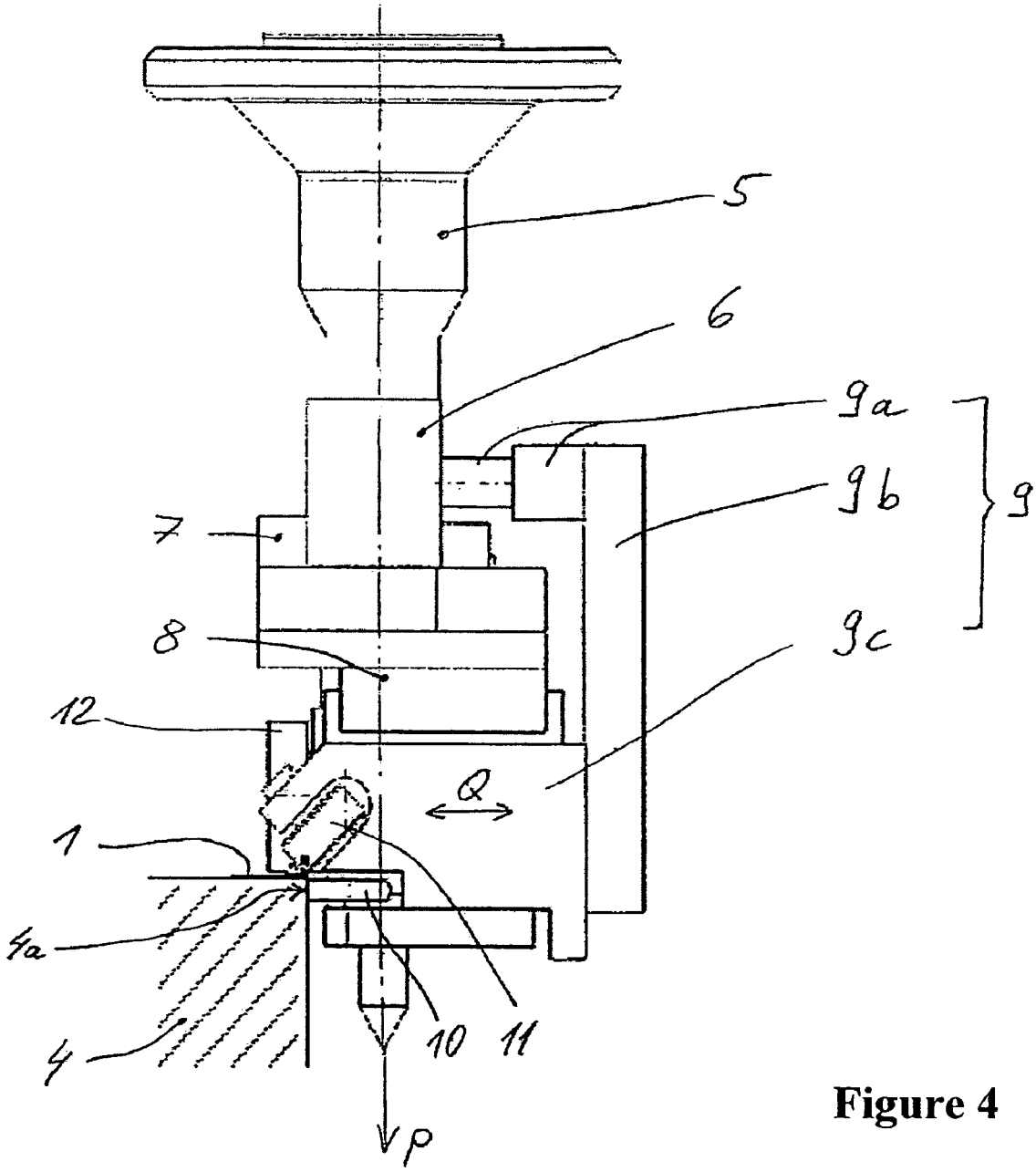
FIG. 4 the first roll-flanging device during roll-flanging, in a view in the longitudinal direction of a flanging edge of the component part.
Figure 5:
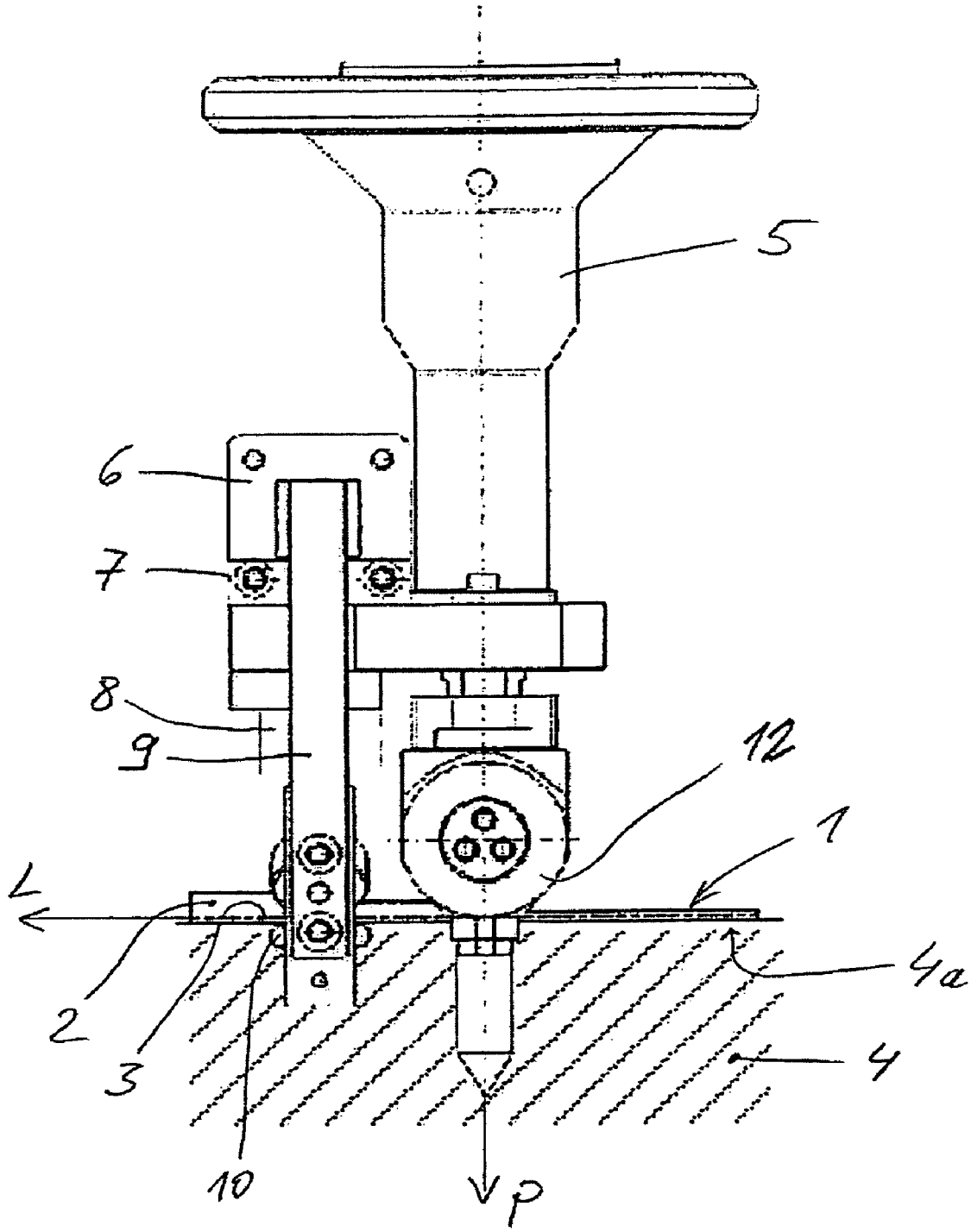
FIG. 5 the first roll-flanging device during roll-flanging, in a view transverse to the flanging edge.
Figure 6:
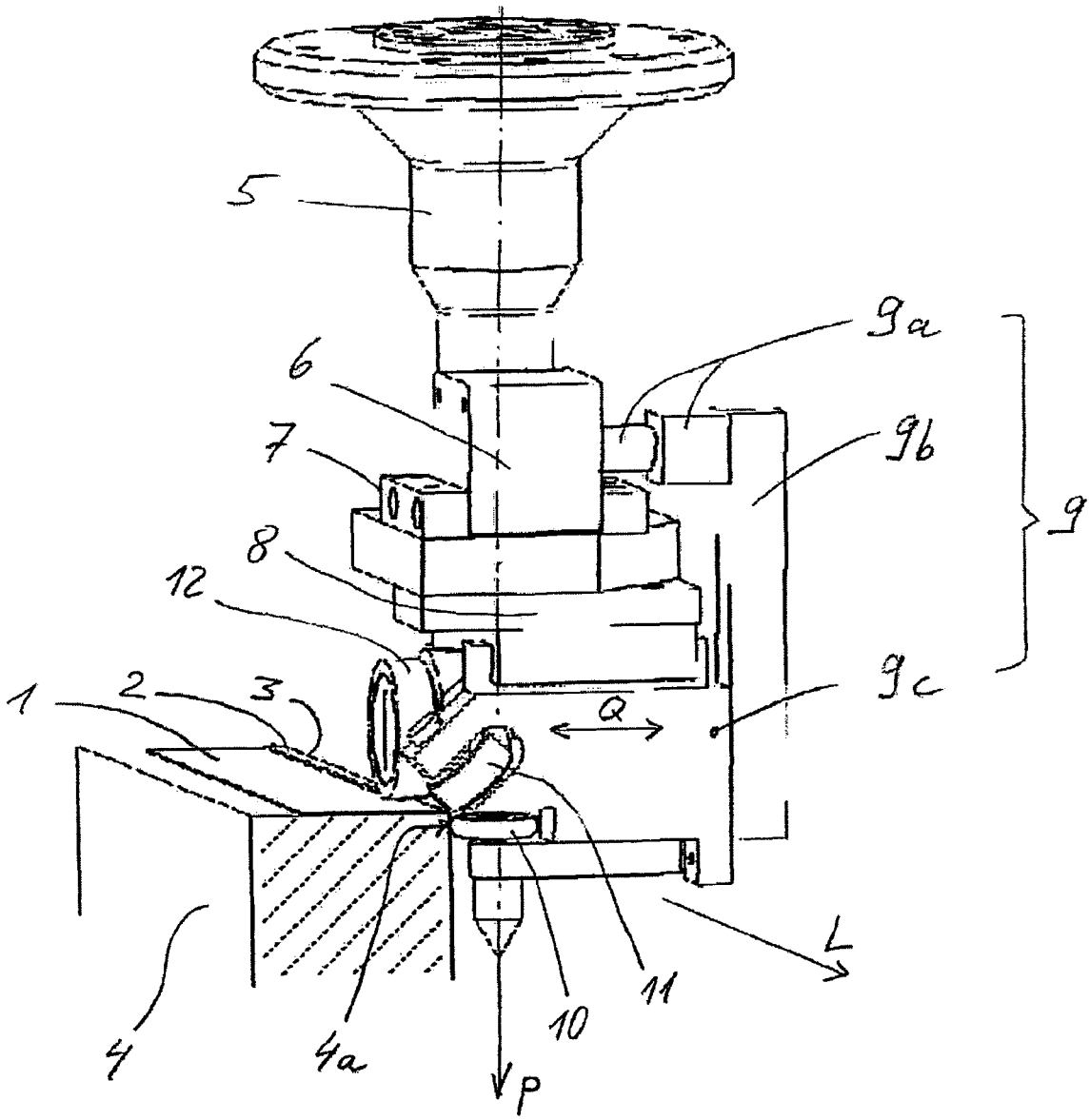
FIG. 6 the first roll-flanging device during roll-flanging, in a perspective view.

FIGS. 4 to 6 show an arrangement for roll-flanging the metal sheet 1, consisting of the roll-flanging device and a component part receptacle 4. FIG. 4 shows a view counter to the processing direction L of the roll-flanging device. FIG. 5 shows the arrangement in a view onto a rear side of the roll-flanging device facing away from the metal sheet 1, and FIG. 6 shows a perspective view.

The metal sheet 1 lies on the component part receptacle 4—a flanging bed—and is either already fixed on the component part receptacle 4 by lying on it or is additionally fixed. The component part receptacle 4 forms a guiding curve 4*a* for the bearing unit 9. The guiding curve 4*a* follows the flanging edge 3 along its side opposite the flanging web 2 and points at least substantially in the direction Q of the transverse mobility of the bearing unit 9; in the example embodiment, it extends exactly perpendicular to the direction Q.

A guiding member 10 is arranged on the bearing unit 9 and is in guiding contact with the guiding curve 4*a* during roll-flanging. The guiding member 10 is formed as a roller and is rotatably mounted by the bearing unit 9 about a rotational axis which is perpendicular to the direction Q and parallel to the axis P. In guiding contact, the guiding member 10 thus rolls off on the guiding curve 4*a* during roll-flanging.

The bearing unit 9 is pressed by means of the pressing means 6, 9*a* in the direction Q, towards the flanging web 2, wherein the pressing means 6, 9*a* simultaneously presses the guiding member 10 against the guiding curve 4*a*. The position of the guiding member 10 relative to the primary flanging roller 11 in the direction Q is selected such that the primary flanging roller 11 beads the flanging web 2 by the angle predefined by the inclination of the primary flanging roller 11, when the guiding member 10 is in guiding contact with the guiding curve 4*a*. The guiding member 10 can only be rotated about its rotational axis, but is otherwise arranged stationary relative to the bearing unit 9. Because the guiding member 10 is pressed into the guiding contact, it follows the contour of the flanging edge 3 when the roll-flanging device is moved in the processing direction L. While the tool head 5 presses onto the flanging web 2 along the axis P and is guided in a controlled or as applicable also regulated way, such that the secondary flanging roller 12 follows the contour of the flanging edge 3, the primary flanging roller 11 can move relative to the secondary flanging roller 12, within the scope of its transverse mobility, so as to compensate for curves arising between the flanging rollers 11 and 12. This is favourably affected by the fact that the primary flanging roller 11 is pressed against the flanging web 2 by an elastic restoring force generated by the pneumatic pressing means 6, 9*a* and so elastically gives, i.e. spring-deflects, if the flanging web 2 is uneven in the transverse direction Q.

For generating the pressing force, the pressing means 6, 9*a* can be charged with a particular pressure via the port 7 and, once the pressure has been built up, can be closed such that the cylinder unit 6 forms a closed chamber. In a preferred alternative embodiment, the pressure in the cylinder 6 during the processing run is regulated to maintain a predefined target value.

In combination with the guiding member 10, the pressing means 6, 9*a* forms an actuating means for the bearing unit 9 and thus for the primary flanging roller 11. However, it does not only serve to press the guiding member 10 onto the guiding curve 4*a* and, consequently, the primary flanging roller 11 against the flanging web 2. In simple embodiments, the pressing means 6, 9*a* can only press the guiding member 10 against the guiding curve 4*a*. In a further development, the pressing means 6, 9*a* also already forms an actuating means on its own, by means of which the primary flanging roller 11 can be moved relative to the secondary flanging roller 12, in the direction Q into the processing position at the beginning of the processing run, and in the opposite direction—which may also be referred to as Q—out of the processing position at the end of the processing run.

In order to start the processing run, the tool head 5 is moved into an initial position, either regulated by means of a sensor system or merely controlled if the position of the metal sheet 1 is stored accordingly. In the initial position of the tool head 5, only the primary flanging roller 11 is pressed against the flanging web 2. The processing run is then started. In a single processing run, the flanging web 2 is beaded in accordance with the inclination of the primary flanging roller 11 in a first flanging step and then beaded further in accordance with the inclination of the secondary flanging roller 12; in the example embodiment, it is completely beaded such that it comes to rest parallel to the peripheral strip of the metal sheet 1 adjacent to the other side of the flanging edge 3. The flanging device is thus particularly suitable for forming a hemmed connection between the metal sheet 1 and another structure which is planar at least in the joining region. By correspondingly orientating the rotational axes of the flanging rollers 11 and 12, the flanging web 2 or a flanging web pre-shaped at a different bending angle can also be beaded, for each flanging step as well as in total, by other bending angles. At the end of the processing run, the primary flanging roller 11 either simply continues in the processing direction L, or the pressing means 6, 9*a* moves the bearing unit 9 and therefore the primary flanging roller 11 in the transverse direction Q, out of the flanging region, such that if the space available is restricted, the secondary flanging roller 12 can be moved further in the longitudinal direction L of the flanging edge 3 and the flanging edge 3 can also be beaded in its end region in accordance with the flanging task. Lastly, the tool head 5 as a whole is moved out of the flanging region.

During the processing run, the tool head 5 is guided either in a regulated or merely a controlled way. If the position is regulated, the tool head is equipped with a corresponding sensor system for detecting the contour of the edge or another suitable reference. If movement is merely controlled, a control means controlling the movement of the tool head 5 has access to a stored data set which represents the contour of the flanging edge 3.

For the actuating movement in the direction Q towards the flanging edge 3 and for generating the pressing force on the one hand, and for the actuating movement in the opposite direction Q away from the flanging edge 3 on the other hand, a further development of the piston unit 9*a* forms a piston which can be pressurised on both sides of the piston, i.e. a double piston, and a further development of the cylinder unit 6 forms a cylinder space which can be pressurised on each of the two sides of the piston.

Figure 7:
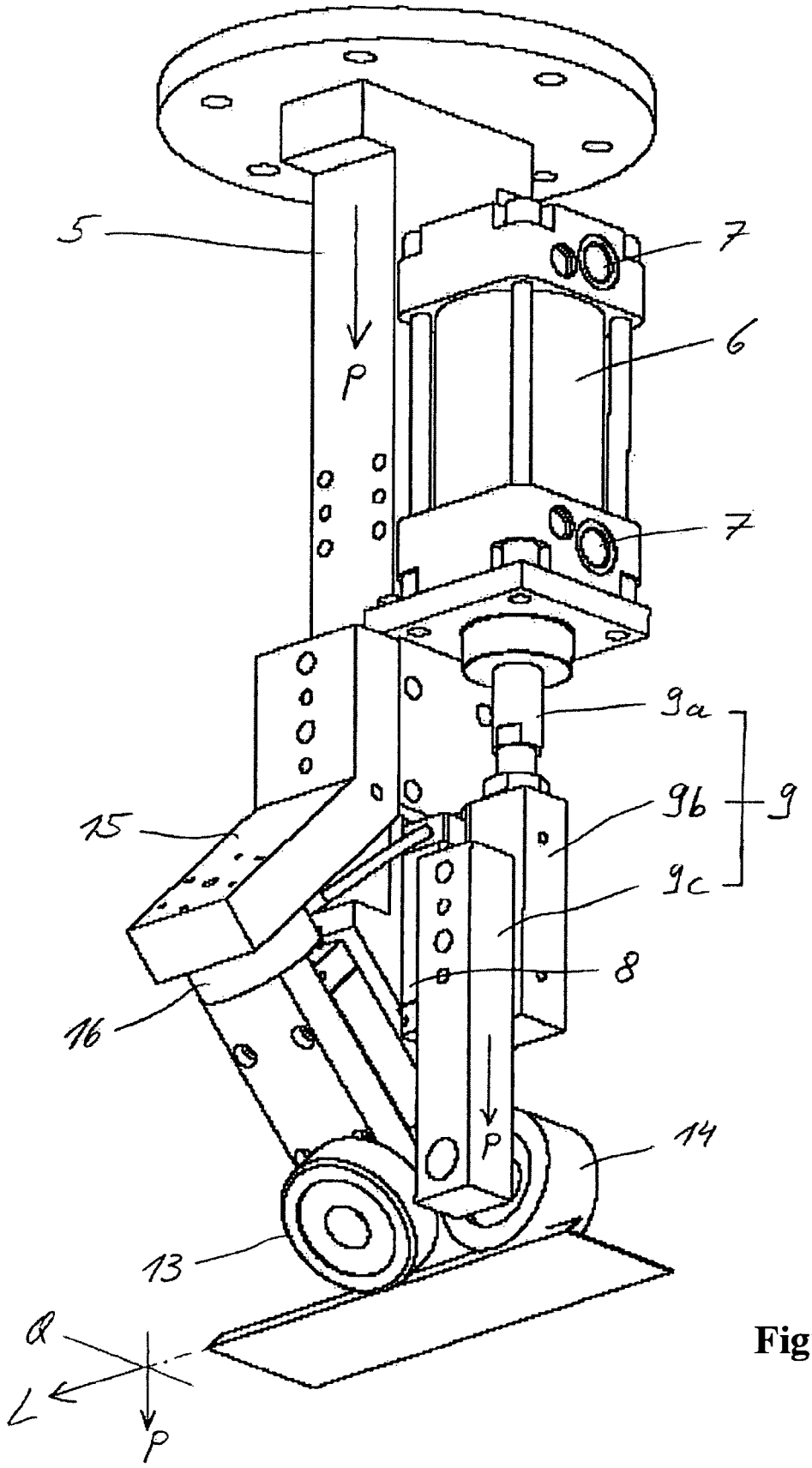
FIG. 7 a second roll-flanging device, in one view.
Figure 8:
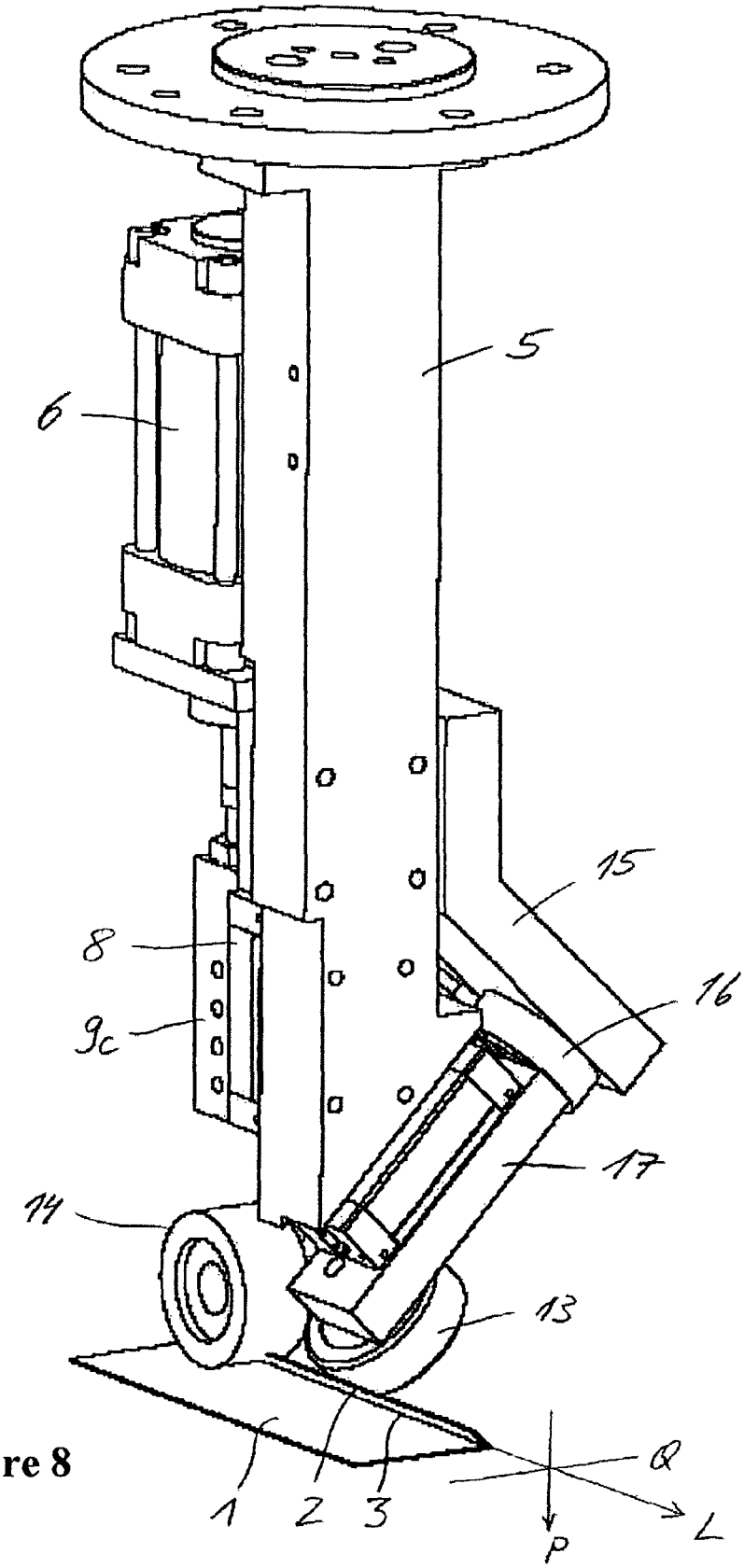
FIG. 8 the second roll-flanging device, in another view.

FIGS. 7 and 8 show a roll-flanging device in a second example embodiment, in two perspective views. Components having the same function as components of the first example embodiment are provided with the reference signs of the first example embodiment. New reference signs are used only for the flanging rollers 13 and 14. The differences with respect to the first example embodiment are described below. Otherwise, the statements made with respect to the first example embodiment apply.

In the second example embodiment, the following roller—the secondary flanging roller 14—can be moved transverse to the longitudinal direction of the flanging edge 3—the processing direction L—and is therefore the first flanging roller in the sense of the invention. It is mounted such that it can be moved parallel to the axis of force P, in and counter to the direction of the force with which the tool head 5 is pressed against the component part 1. In the L,P,Q co-ordinate system of the tool head 5, the angular position with respect to all the co-ordinate axes and the location of the secondary flanging roller 14 with respect to the axes L and Q is mechanically fixed, as is also the case for the secondary flanging roller 12 in the first example embodiment.

The primary flanging roller 13 is supported via a load cell 16, but is otherwise arranged both stationary on the tool head 5 and fixed with respect to its angular position. With regard to the angular position and to fixing the location with respect to the axis L, it corresponds to the primary flanging roller 11 of the first example embodiment. The load cell 16 serves to measure the force with which the primary flanging roller 13 presses against the flanging web 2 and, on the basis of this, to set the optimum force for the primary flanging step. The load cell 16 can include a bound spring, and the primary flanging roller 13 can be mounted on the tool head 5 via the load cell 16, as described in DE 100 11 854 A1. Reference is made to DE 100 11 854 A1 in this respect. For practical purposes, a fixed arrangement can be assumed for the primary flanging roller 13, particularly since the load cell 16 can be omitted in a simplified embodiment and the primary flanging roller 13 is then fixed to the tool head 5. The movement trajectory of the tool head is advantageously optimised by means of the load cell 16.

The cylinder unit 6 is fastened to the tool head 5, pivoted by 90° in accordance with the changed direction of the transverse mobility. The piston unit 9*a* therefore extends and retracts in the transverse direction P, and with it the other parts 9*b* and 9*c* of the bearing unit 9 fastened to it. In the region of its connecting structure 9*b*, the bearing unit 9 is linearly guided in the transverse direction P by the guide 8, secured against rotating. The bearing structure 9*c*, which rotatably mounts the secondary flanging roller 14, is rigidly connected to the piston unit 9*a* via the connecting structure 9*b*. The bearing unit 9 is again rigid within itself. The cylinder unit 6 comprises two ports 7 for a pressurised gas, preferably pressurised air, in order to be able to pressurise the piston of the piston unit 9*a* on both sides and to move the bearing unit 9 back and forth in the transverse direction P.

The bearing unit 9 can be extended in the acting direction P far enough that the secondary flanging roller 14 protrudes beyond the primary flanging roller 13 far enough that if a flanging edge 3 is linear and at a right angle to the axis P, the secondary flanging roller 14 can act on the flanging web 2 even without the primary flanging roller 13. It can also be retracted counter to the acting direction P far enough that the secondary flanging roller 14 is far enough short of the primary flanging roller 13 that if a flanging edge 3 is linear and at a right angle to the axis P, the primary flanging roller 13 can act on the flanging web 2 even without the secondary flanging roller 14.

The pressure with which the secondary flanging roller 14 acts on the flanging web 2 is kept constant during a processing run. To this end, the bearing unit 9 is charged with a correspondingly selected actuating force—in the example embodiment, with a gas pressure in the cylinder unit 6 which a pressure regulating means keeps constant. By keeping the effective pressure of the secondary flanging roller 14 constant, unevenness which the component part 1 may have in the flanging region is compensated for.

Once the tool head 5 has been placed on the component part 1, the flanging web 2 is completely beaded in two flanging steps which the tool head 5 performs in the same processing run. The secondary flanging roller 14, acting on the flanging web 2 with a constant pressure, ensures a high quality of shape in the flanged peripheral region of the component part 1. If the flanging edge 3 comprises a corner region, as for example with sunroofs or vehicle doors, the primary flanging roller 13 passes over the corner region. For passing over the corner region in this way, the bearing unit 9 is retracted far enough that the secondary flanging roller 14 cannot act on the flanging web 2 in the corner region. Once the primary flanging roller 13 has beaded the corner region, the tool head 5 is moved slightly away from the flanging web 2 in the next step, such that the primary flanging roller 13 lifts off the flanging web 2. Synchronously with lifting the primary flanging roller 13 off, the bearing unit 9 is extended such that the secondary flanging roller 14 is again moved into its processing position. The tool head 5 is then moved back to before the corner region again, in a reversal of the processing direction L, such that the flanging web 2 is completely beaded in the corner region by means of the secondary flanging roller 14 while the primary flanging roller 13 remains lifted off. The tool head 5 then passes over the corner region again, with the primary flanging roller 13 lifted off and the secondary flanging roller 14 in its processing position, in order to "iron" the component part 1 in the corner region and therefore improve the quality of the component part. Directly after the secondary flanging roller 14 has passed over the corner region in the original processing direction L, the tool head 5 is advanced in the direction P towards the flanging web 2 and the bearing unit 9 is synchronously retracted until both flanging rollers 13 and 14 simultaneously press onto the flanging web 2 again and successively bead it in the subsequent course of the processing run.

In another example embodiment, which however is not shown, a flanging device in accordance with the invention comprises the primary flanging roller 11 of the first example embodiment and the secondary flanging roller 14 of the second example embodiment.

LIST OF REFERENCE SIGNS

1 component part, metal sheet
2 flanging web
3 flanging edge
4 component part receptacle
4*a* guiding curve
5 tool head
6 cylinder unit
7 pressurised gas port
8 guide
9 bearing unit
9*a* piston unit
9*b* connecting structure
9*c* bearing structure
10 guiding member
11 first flanging die, primary flanging roller
12 second flanging die, secondary flanging roller
13 second flanging die, primary flanging roller
14 first flanging die, secondary flanging roller
15 limb
16 load cell
17 limb
L processing direction
P transverse direction, axis of force
Q transverse direction

The invention claimed is:

1. A flanging device for beading a flanging web of a component part around a flanging edge, said flanging device comprising:

a) a tool head;

b) a first flanging die and a second flanging die which the tool head bears, simultaneously situated in a processing position, and one of which is arranged following the other in a processing direction;

c) a bearing unit which mounts the first flanging die and is mounted by the tool head such that the bearing unit can be moved in a transverse direction relative to the processing direction; and d) an actuating means which the tool head bears, wherein the bearing unit is chargeable, by means of the actuating means, with a force which acts in the transverse direction;

wherein the first flanging die can be advanced by means of the actuating means in the transverse direction towards the flanging web far enough that the first flanging die protrudes beyond the second flanging die and can be moved back in the transverse direction far enough from the flanging web that it is short of the second flanging die.

2. The flanging device according to claim 1 further comprising a guide which guides the bearing unit on the tool head in the transverse direction.

3. The flanging device according to claim 1, wherein the flanging die which is arranged as following is a finishing flanging roller for completely beading the flanging web.

4. The flanging device according to claim 1, wherein the first and second flanging dies are fixable relative to each other on the tool head with respect to a plurality of degrees of freedom of movement.

5. The flanging device according to claim 1, wherein the second flanging die is supported on the tool head via a force measuring means.

6. The flanging device according to claim 1, wherein the first flanging die can be moved transverse to the flanging edge relative to the second flanging die, following the contour of the flanging edge, in order to compensate for a curve in the flanging edge.

7. The flanging device according to claim 1, wherein the first flanging die is arranged following the second flanging die.

8. The flanging device according to claim 1, wherein the second flanging die is arranged following the first flanging die.

9. The flanging device according to claim 1 wherein the tool head bears an actuating means, by means of which the bearing unit can be charged transverse to the flanging edge with a force which causes a transverse movement of the bearing unit relative to the second flanging die.

10. The flanging device according to claim 1 wherein a guiding member is arranged on the bearing unit, for a guiding contact with a guiding curve, wherein in the guiding contact of the guiding member, the bearing unit is moved in the transverse direction, following the contour of the flanging edge, and the bearing unit mounts the first flanging die such that it can be moved transversely together with the guiding member.

11. The flanging device according to any claim 1, wherein the tool head mounts the bearing unit such that it can be moved transversely counter to a restoring force.

12. The flanging device according to claim 1, wherein the bearing unit is pneumatically supported on the tool head.

13. The flanging device according to claim 1 wherein the tool head mounts the bearing unit such that it can be moved parallel to or angularly to a pressure which the first flanging die exerts on the flanging web during beading.

14. The flanging device according to claim 1, wherein at least one of the flanging dies is a flanging roller.

15. The flanging device according to claim 1 wherein the transverse direction has at least a direction component in common with a rotational axis of one of the flanging dies which is formed as a flanging roller or with an axis pointing at a right angle to the rotational axis.

16. The flanging device according to claim 1 wherein the flanging device is used for hemming on a vehicle part

17. The flanging device according to claim 1, wherein the force is constant.

18. The flanging device according to claim 1, wherein the force is adjustable.

19. The flanging device according to claim 4, wherein the first and second flanging dies are fixable relative to each other at an inclination which is invariable at least during flanging.

20. The flanging device according to claim 11, wherein the restoring force is an elasticity force.

21. The flanging device according to claim 16, wherein the flanging device is used for roll-hemming on a vehicle part.

22. A method for beading a flanging web of a component part around a flanging edge, comprising:

a) moving a tool head, which bears a leading flanging die and a following flanging die, along the flanging edge in a processing run, wherein the tool head bears one of the flanging dies such that it can be moved transverse to the flanging edge relative to the other flanging die;

b) beading the flanging web with the leading flanging die; and c) further beading the flanging web with the following flanging die in the same processing run;

wherein a corner region of the flanging edge is passed over repeatedly, by reversing the processing direction, and in a first pass, the following flanging die is lifted off the flanging web and in a subsequent, second pass, the leading flanging die is lifted off the flanging web, while in each pass, the other flanging die in each case beads the flanging web.

23. The method according to claim 22, wherein, during beading, at least one of the flanging dies spring-deflects relative to the other in a direction which is transverse to the flanging edge and also angular or at least substantially parallel to a pressure which the spring-deflecting flanging die exerts on the flanging web during beading.

24. The method according to claim 22, wherein the component part is accommodated by a component part receptacle which absorbs a pressure exerted by the flanging dies.

25. The method according to claim 22, wherein at least one of the flanging dies acts on the flanging web with a constant pressure.

* * * * *